US008522568B2

(12) United States Patent
Okamoto et al.

(10) Patent No.: US 8,522,568 B2
(45) Date of Patent: Sep. 3, 2013

(54) REFRIGERATION SYSTEM

(75) Inventors: Tetsuya Okamoto, Osaka (JP); Shinichi Kasahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 339 days.

(21) Appl. No.: 12/919,942

(22) PCT Filed: Feb. 27, 2009

(86) PCT No.: PCT/JP2009/000893

§ 371 (c)(1),
(2), (4) Date: Aug. 27, 2010

(87) PCT Pub. No.: WO2009/107395

PCT Pub. Date: Sep. 3, 2009

(65) Prior Publication Data

US 2011/0000239 A1 Jan. 6, 2011

(30) Foreign Application Priority Data

Feb. 28, 2008 (JP) ..... 2008-048540

(51) Int. Cl.
*F25B 5/00* (2006.01)

(52) U.S. Cl.
USPC ..... 62/200; 62/199; 62/224; 62/205

(58) Field of Classification Search
USPC ..... 62/199, 200
See application file for complete search history.

(56) References Cited

U.S. PATENT DOCUMENTS 6,126,080 A * 10/2000 Wada ..... 236/51
2005/0115271 A1 6/2005 Takegami et al.
2006/0123810 A1 6/2006 Ha et al.

FOREIGN PATENT DOCUMENTS

JP 61-195255 A 8/1986
JP 2004-44921 A 2/2004
JP 2005-226950 A 8/2005

* cited by examiner

*Primary Examiner* — Frantz F. Jules
*Assistant Examiner* — Anuj Kapadia
(74) *Attorney, Agent, or Firm* — Birch, Stewart, Kolasch & Birch, LLP.

(57) ABSTRACT

An air conditioner (1) includes a refrigerant circuit (10) configured to perform a supercritical refrigeration cycle and including: an outdoor circuit (21) including a compressor (22), an outdoor heat exchanger (23), and an outdoor expansion valve (24); and two indoor circuits (31*a*, 31*b*) including indoor heat exchangers (33*a*, 33*b*) and indoor expansion valves (34*a*, 34*b*). The air conditioner (1) further includes a controller (50) configured to control outlet refrigerant temperatures of the indoor heat exchangers (33*a*, 33*b*). The controller (50) includes a valve control part (50*a*) configured to adjust the opening degrees of the indoor expansion valves (34*a*, 34*b*) such that a deviation of the outlet refrigerant temperature of each of the indoor heat exchangers (33*a*, 33*b*) from an average value of the outlet refrigerant temperatures of all the indoor heat exchangers (33*a*, 33*b*) approaches a deviation of a target value which is a deviation, from the average value, of a target refrigerant temperature of the outlet refrigerant temperature of each of the indoor heat exchangers (33*a*, 33*b*).

1 Claim, 5 Drawing Sheets

REFRIGERATION SYSTEM

TECHNICAL FIELD

The present disclosure relates to refrigeration systems, and more particularly to measures for controlling an outlet refrigerant temperature of a heat-dissipation side heat exchanger in a refrigeration cycle in which a high-pressure refrigerant has a pressure higher than or equal to a critical pressure.

BACKGROUND ART

Refrigeration systems performing refrigeration cycles by circulating refrigerants are conventionally widely used for air conditioners. Examples of such air conditioners include a multi-type air conditioner in which a plurality of indoor units are connected in parallel to each other and each of the indoor units is connected in parallel to an outdoor unit.

For example, an air conditioner proposed in Patent Document 1 includes: an outdoor unit including a compressor, an outdoor heat exchanger (i.e., a heat-source side heat exchanger) and an outdoor expansion valve; and two indoor units each including an indoor heat exchanger (i.e., an application side heat exchanger). Two branch pipes respectively connected to the two indoor heat exchangers have indoor expansion valves of the indoor heat exchangers. The indoor refrigeration capability of this air conditioner in heating operation is controlled by adjusting the opening degree of the indoor expansion valve based on the degree of supercooling by each of the indoor heat exchangers.

CITATION LIST

Patent Document

Patent Document 1: Japanese Patent Publication No. 2004-44921

SUMMARY OF THE INVENTION

Technical Problem

However, in a refrigeration system using carbon dioxide as a refrigerant, a refrigeration cycle (i.e., a supercritical refrigeration cycle) in which a high-pressure refrigerant has a pressure higher than or equal to a critical pressure is performed. Accordingly, the indoor refrigeration capability cannot be adjusted based on the degree of supercooling of each indoor heat exchanger. Thus, in a refrigeration system performing a supercritical refrigeration cycle, the outlet refrigerant temperature of the indoor heat exchanger is used as a direct parameter, and the opening degree of the indoor expansion valve is adjusted such that this outlet refrigerant temperature reaches a target refrigerant temperature.

However, the condensation region of the refrigerant is not fixed in the supercritical refrigeration cycle, the temperature of the high-pressure refrigerant changes in a wide range, and the outlet refrigerant temperature changes according to this change of the high-pressure refrigerant.

Specifically, as illustrated in FIG. 5, for example, when the pressure of the high-pressure refrigerant increases from a state in which the outlet refrigerant temperature Tgc(1) and the target refrigerant temperature Tgc(S1) of the indoor heat exchanger are 30° C., the outlet refrigerant temperature Tgc (1) increases to Tgc(2) according to this pressure increase. At this time, since the target refrigerant temperature Tgc(S1) does not vary, a temperature difference occurs between the outlet refrigerant temperature Tgc(2) and the target refrigerant temperature Tgc(S1) (i.e., Tgc(2)>Tgc(S1)). Therefore, the opening degree of the indoor expansion valve is reduced to reduce the amount of the circulating refrigerant so that the outlet refrigerant temperature Tgc(2) approaches the target refrigerant temperature Tgc(S1).

On the other hand, as illustrated in FIG. 6, when the pressure of the high-pressure refrigerant decreases from a state in which the outlet refrigerant temperature Tgc(2) and the target refrigerant temperature Tgc(S2) are 30° C., the outlet refrigerant temperature Tgc(2) decreases to Tgc(3) according to this pressure decrease. At this time, since the target refrigerant temperature Tgc(S2) does not vary, a temperature difference occurs between the outlet refrigerant temperature Tgc(3) and the target refrigerant temperature Tgc(S2) (i.e., Tgc(3)<Tgc (S2)). Therefore, the opening degree of the indoor expansion valve is increased to increase the amount of the circulating refrigerant so that the outlet refrigerant temperature Tgc(3) approaches the target refrigerant temperature Tgc(S2).

In this manner, in a conventional control method, the value of the outlet refrigerant temperature itself is used as a target refrigerant temperature. Thus, the opening degree of the indoor expansion valve needs to be frequently adjusted at every frequent change in the actual outlet refrigerant temperature of the indoor heat exchanger. Consequently, the opening degree of the indoor expansion valve becomes unstable, and as a result, the outlet refrigerant temperature of the indoor heat exchanger also becomes unstable, leading to instability of the indoor refrigeration capability.

It is therefore an object of the present invention to stabilize the opening degree of a control valve to stabilize the refrigeration capability even with a change in an outlet refrigerant temperature of an indoor heat exchanger caused by a pressure change of a high-pressure refrigerant.

Solution to the Problem

A first aspect of the present invention is directed to a refrigeration system including a refrigerant circuit (10) configured to perform a refrigeration cycle in which a high-pressure refrigerant has a pressure higher than or equal to a critical pressure, and including a heat-source side circuit (21) including a compressor (22), a heat-source side heat exchanger (23), and an expansion mechanism (24), and a plurality of application side circuits (31*a*, 31*b*) which include application side heat exchangers (33*a*, 33*b*) connected to control valves (34*a*, 34*b*) with adjustable opening degrees and are connected in parallel to the heat-source side circuit (21); and a controller (50) configured to control an outlet refrigerant temperature of each of the application side heat exchangers (33*a*, 33*b*) to a predetermined temperature during heat dissipation of each of the application side heat exchangers (33*a*, 33*b*).

The controller (50) includes a valve control part (50*a*) configured to adjust the opening degrees of the control valves (34*a*, 34*b*) of the application side circuits (31*a*, 31*b*) such that a deviation of the outlet refrigerant temperature of each of the application side heat exchangers (33*a*, 33*b*) of the application side circuits (31*a*, 31*b*) from an average of the outlet refrigerant temperatures of all the application side heat exchangers (33*a*, 33*b*) reaches a predetermined target value.

In the first aspect, the refrigerant circulates in the refrigerant circuit (10), and a vapor compression refrigeration cycle is performed. For example, the refrigerant compressed in the compressor (22) dissipates heat in the application side heat exchangers (33*a*, 33*b*) to perform heating operation for a room. At this time, the valve control part (50*a*) of the controller (50) calculates the average value of the outlet refrigerant temperatures of all the application side heat exchangers (33*a*, 33*b*) to obtain a deviation, from the average value, of the outlet refrigerant temperature of one of the application side heat exchangers (33*a*, 33*b*) to be controlled. This deviation can be kept constant even with a change in the outlet refrigerant temperatures of the application side heat exchangers (33*a*, 33*b*) caused by a change in the pressure of the high-pressure refrigerant. Then, the valve control part (50*a*) adjusts the opening degree of one of the control valves (34*a*, 34*b*) of the application side heat exchanger (33*a*, 33*b*) to be controlled such that the deviation approaches a predetermined target value.

In a second aspect of the present invention, in the refrigeration system of the first aspect, the target value used by the valve control part (50*a*) is a deviation, from the average value, of a target refrigerant temperature of the outlet refrigerant temperature of each of the application side heat exchangers (33*a*, 33*b*) based on a target air temperature of a room in which the each of the application side heat exchangers (33*a*, 33*b*) is located.

In the second aspect, a deviation, from the average value, of the target refrigerant temperature of the outlet refrigerant temperature of each of the application side heat exchangers (33*a*, 33*b*) based on a target air temperature which is a difference between the current room temperature and a temperature set by a user, is calculated, for example, and is used as a target value. That is, the difference between the target refrigerant temperature and the average value is used as the target value. Then, the opening degree of one of the control valves (34*a*, 34*b*) of the application side heat exchanger (33*a*, 33*b*) to be controlled is adjusted such that the deviation, from the average value, of the actual outlet refrigerant temperature in the application side heat exchanger (33*a*, 33*b*) to be controlled approaches the target value.

Specifically, when the target value is increased by increasing the target refrigerant temperature of the outlet refrigerant temperature of one application side heat exchanger (33*a*), the opening degree of the control valve (34*a*) of the application side heat exchanger (33*a*) to be controlled is increased. Consequently, the amount of the circulating refrigerant increases, the outlet refrigerant temperature of the application side heat exchanger (33*a*) increases, and thus, a deviation of the outlet refrigerant temperature from the average value approaches the target value. That is, the outlet refrigerant temperature of the application side heat exchanger (33*a*) approaches the target refrigerant temperature. On the other hand, the target value of the other application side heat exchanger (33*b*) is constant, and a deviation of the outlet refrigerant temperature of the application side heat exchanger (33*b*) from the average value hardly varies. Consequently, the control valve (34*b*) of the application side heat exchanger (33*b*) maintains substantially an identical opening degree, and the outlet refrigerant temperature of the application side heat exchanger (33*b*) is kept at the target refrigerant temperature.

When the target refrigerant temperature of the outlet refrigerant temperature of the application side heat exchanger (33*a*) is reduced to reduce the target value, the opening degree of the control valve (34*a*) of the application side heat exchanger (33*a*) to be controlled decreases. Consequently, the amount of the circulating refrigerant decreases, the outlet refrigerant temperature of the application side heat exchanger (33*a*) decreases, and thus, a deviation of the outlet refrigerant temperature from the average value approaches the target value. That is, the outlet refrigerant temperature of the application side heat exchanger (33*a*) approaches the target refrigerant temperature. On the other hand, the target value of the other application side heat exchanger (33*b*) is constant, and a deviation of the outlet refrigerant temperature of the application side heat exchanger (33*b*) from the average value hardly varies. Consequently, the control valve (34*b*) of the application side heat exchanger (33*b*) maintains substantially an identical opening degree, and the outlet refrigerant temperature of the application side heat exchanger (33*b*) is kept at the target refrigerant temperature.

Advantages of the Invention

With the configuration of the first aspect, a deviation of the outlet refrigerant temperature of each of the application side heat exchangers (33*a*, 33*b*) from an average value of the outlet refrigerant temperature of all the application side heat exchangers (33*a*, 33*b*) is calculated, and then, adjustment is performed such that the deviation approaches a predetermined target value. Thus, even with a change in the outlet refrigerant temperature of each of the application side heat exchangers (33*a*, 33*b*) caused by a change in the pressure of the high-pressure refrigerant, a change in the deviation can be reduced. As a result, even with a change in the pressure of the high-pressure refrigerant, the opening degrees of the control valves (34*a*, 34*b*) do not need to be adjusted, thereby stabilizing control of the outlet refrigerant temperature of the application side heat exchangers (33*a*, 33*b*).

With the configuration of the second aspect, a deviation, from the average value, of the target refrigerant temperature of the outlet refrigerant temperature of each of the application side heat exchangers (33*a*, 33*b*) based on a target air temperature for a room, is used as a target value. Thus, when the target refrigerant temperature of the outlet refrigerant temperature of one application side heat exchanger (33*a*) is changed, the outlet refrigerant temperature of the application side heat exchanger (33*a*) can follow the target refrigerant temperature. As a result, control of the outlet refrigerant temperature of the indoor heat exchanger (33*a*) is affected by a change in the pressure of the high-pressure refrigerant.

In addition, the use of the deviation, from the average value, of the target refrigerant temperature of the outlet refrigerant temperature of each of the application side heat exchangers (33*a*, 33*b*) based on a target air temperature for a room, eases determination of the degree (i.e., sufficient or insufficient) of the capability of each of the indoor heat exchangers (33*a*, 33*b*). Accordingly, the outlet refrigerant temperature of the indoor heat exchanger (33*a*) according to the required capabilities of the indoor heat exchangers (33*a*, 33*b*) can be appropriately controlled. Consequently, an unnecessary input to the compressor (22) can be reduced, thereby saving energy. In addition, air conditioning ability corresponding to the required capability of each of the indoor heat exchangers (33*a*, 33*b*) can be obtained with stability, thereby enhancing comfortableness.

DESCRIPTION OF REFERENCE CHARACTERS

Figure 1:
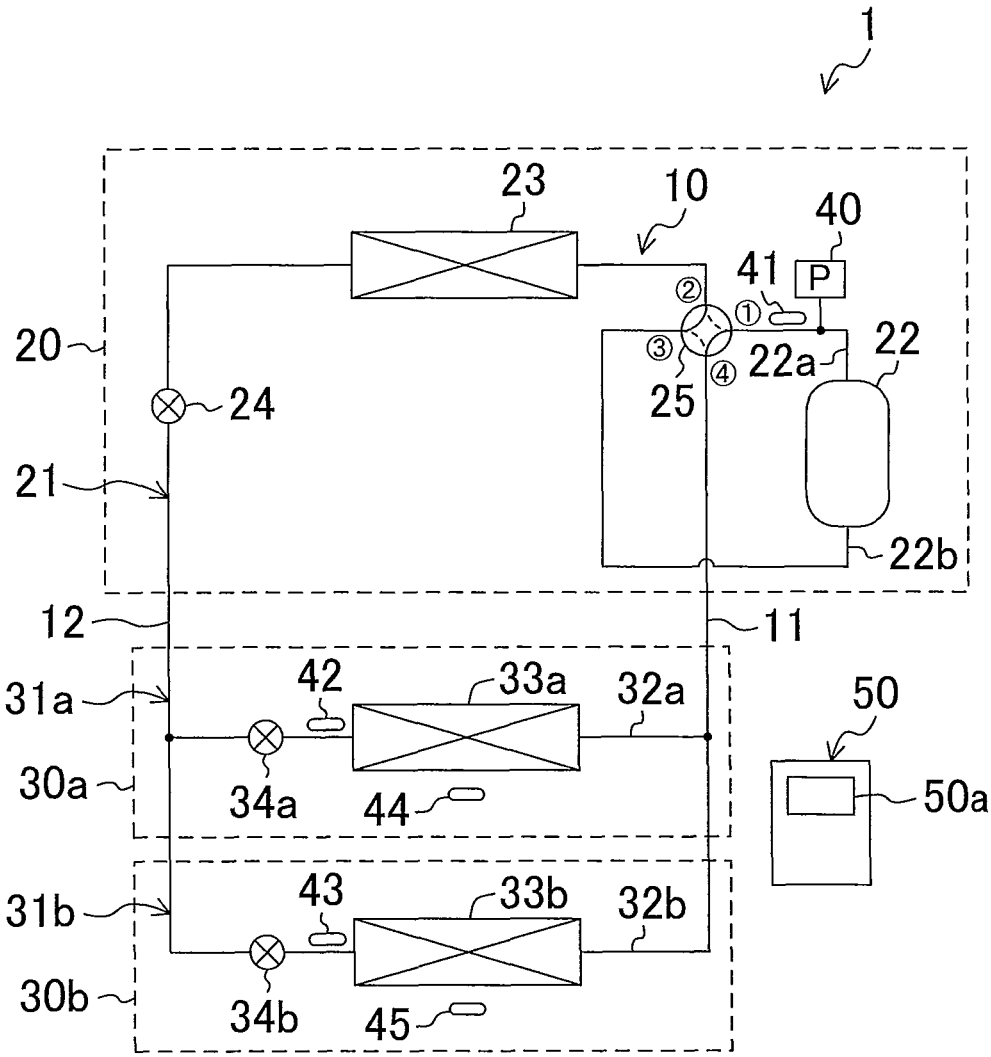
FIG. 1 is a piping diagram showing a refrigerant circuit of an air conditioner according to an embodiment.

10 refrigerant circuit
21 heat-source side circuit
22 compressor
23 outdoor heat exchanger
24 outdoor expansion valve
31*a* first indoor circuit
31*b* second indoor circuit
33*a* first indoor heat exchanger
33*b* second indoor heat exchanger
34*a* first indoor expansion valve
34*b* second indoor expansion valve
50 controller

DESCRIPTION OF EMBODIMENTS

An embodiment of the present invention will be described hereinafter with reference to the drawings.

As illustrated in FIG. 1, a refrigeration system according to this embodiment is an air conditioner capable of being switched between cooling operation and heating operation, and constitutes a so-called multi-type air conditioner (1). This air conditioner (1) includes one outdoor unit (20) placed outside, and first and second indoor units (30*a*) and (30*b*) placed in different rooms.

The outdoor unit (20) includes an outdoor circuit (21) constituting a heat-source side circuit. The first indoor unit (30*a*) includes a first indoor circuit (31*a*) constituting an application side circuit. The second indoor unit (30*b*) includes a second indoor circuit (31*b*) constituting an application side circuit. The indoor circuits (31*a*, 31 *b*) are connected in parallel to each other, and are connected to the outdoor circuit (21) through a first connection pipe (11) and a second connection pipe (12). In this manner, in this air conditioner (1), a refrigerant circuit (10) in which a refrigerant circulates to perform a refrigeration cycle is formed. The refrigerant circuit (10) includes carbon dioxide as the refrigerant to perform a supercritical refrigeration cycle.

The outdoor circuit (21) includes a compressor (22), an outdoor heat exchanger (23) serving as an evaporator during heating operation and as a heat dissipater during cooling operation, an outdoor expansion valve (24), and a four-way selector valve (25). The compressor (22) is a high-pressure domed hermetic scroll compressor. This compressor (22) is supplied with power through an inverter. Specifically, the capacity of the compressor (22) can be changed by changing the output frequency of the inverter to change the rotation speed of a motor of the compressor. The outdoor heat exchanger (23) is a cross-fin type fin-and-tube heat exchanger, and constitutes a heat-source side heat exchanger. In this outdoor heat exchanger (23), heat exchange is performed between a refrigerant and outdoor air. The outdoor expansion valve (24) is made of an electronic expansion valve having an adjustable opening degree, and constitutes an expansion mechanism.

The four-way selector valve (25) includes first through fourth ports. In this four-way selector valve (25), the first port is connected to a discharge pipe (22*a*) of the compressor (22), the second port is connected to the outdoor heat exchanger (23), the third port is connected to a suction pipe (22*b*) of the compressor (22), and the fourth port is connected to the first connection pipe (11). The four-way selector valve (25) can be switched between a state (indicated by solid lines in FIG. 1) in which the first port communicates with the fourth port and the second port communicates with the third port and a state (indicated by broken lines in FIG. 1) in which the first port communicates with the second port and the third port communicates with the fourth port.

The first indoor circuit (31*a*) includes a first branch pipe (32*a*) having one end connected to the first connection pipe (11) and the other end connected to the second connection pipe (12). On the first branch pipe (32*a*), a first indoor heat exchanger (33*a*) serving as a heat dissipater during heating operation and as an evaporator during cooling operation, and a first indoor expansion valve (34*a*) are provided. The second indoor circuit (31*b*) includes a second branch pipe (32*b*) having one end connected to the first connection pipe (11) and the other end connected to the second connection pipe (12). On the second branch pipe (32*b*), a second indoor heat exchanger (33*b*) serving as a heat dissipater during heating operation and as an evaporator during cooling operation, and a second indoor expansion valve (34*b*) are provided.

The indoor heat exchangers (33*a*, 33*b*) are cross-fin type fin-and-tube heat exchangers, and respectively constitute application side heat exchangers. In each of the indoor heat exchangers (33*a*, 33*b*), heat exchange is performed between a refrigerant and indoor air.

The first indoor expansion valve (34*a*) and the second indoor expansion valve (34*b*) constitute control valves, and are made of electronic expansion valves having adjustable opening degrees. The first indoor expansion valve (34*a*) is provided on the first branch pipe (32*a*) at a position close to the second connection pipe (12). The second indoor expansion valve (34*b*) is provided on the second branch pipe (32*b*) at a position close to the second connection pipe (12). The first indoor expansion valve (34*a*) controls the circulation amount of a refrigerant flowing in the first indoor heat exchanger (33*a*). The second indoor expansion valve (34*b*) controls the circulation amount of a refrigerant flowing in the second indoor heat exchanger (33*b*).

The refrigerant circuit (10) includes a high-pressure pressure sensor (40), a high-pressure temperature sensor (41), a first refrigerant temperature sensor (42), and a second refrigerant temperature sensor (43). The high-pressure pressure sensor (40) detects the pressure of a refrigerant discharged from the compressor (22). The high-pressure temperature sensor (41) detects the temperature of the refrigerant discharged from the compressor (22). The first refrigerant temperature sensor (42) is provided at a refrigerant outlet of the first indoor heat exchanger (33*a*) during heating operation, and detects the temperature (i.e., the outlet refrigerant temperature Tgc(1)) of the refrigerant immediately after flowing from the first indoor heat exchanger (33*a*). The second refrigerant temperature sensor (43) is provided at a refrigerant outlet of the second indoor heat exchanger (33*b*) during heating operation, and detects the temperature (i.e., the outlet refrigerant temperature Tgc(2)) of the refrigerant immediately after the second indoor heat exchanger (33*b*).

In the first indoor unit (30*a*), a first indoor-temperature sensor (44) is provided near the first indoor heat exchanger (33*a*). The first indoor-temperature sensor (44) detects the temperature of indoor air around the first indoor heat exchanger (33*a*). In the second indoor unit (30*b*), a second indoor-temperature sensor (45) is provided near the second indoor heat exchanger (33*b*). The second indoor-temperature sensor (45) detects the temperature of indoor air around the second indoor heat exchanger (33*b*).

The air conditioner (1) further includes a controller (50) configured to control the outlet refrigerant temperature of the first indoor heat exchanger (33*a*) and the outlet refrigerant temperature of the second indoor heat exchanger (33*b*). The controller (50) includes a valve control part (50*a*). The valve control part (50*a*) adjusts the opening degrees of the indoor expansion valves (34*a*, 34*b*) in the indoor heat exchangers (31*a*, 31*b*) such that a deviation of each of the outlet refrigerant temperatures of the indoor heat exchangers (33*a*, 33*b*) from an average value of the outlet refrigerant temperatures of the indoor heat exchangers (33*a*, 33*b*) reaches a target value.

Control of the outlet refrigerant temperatures of the indoor heat exchangers (33*a*, 33*b*) in the refrigerant circuit (10) of this embodiment will be described hereinafter with reference to the drawings.

Figure 2:
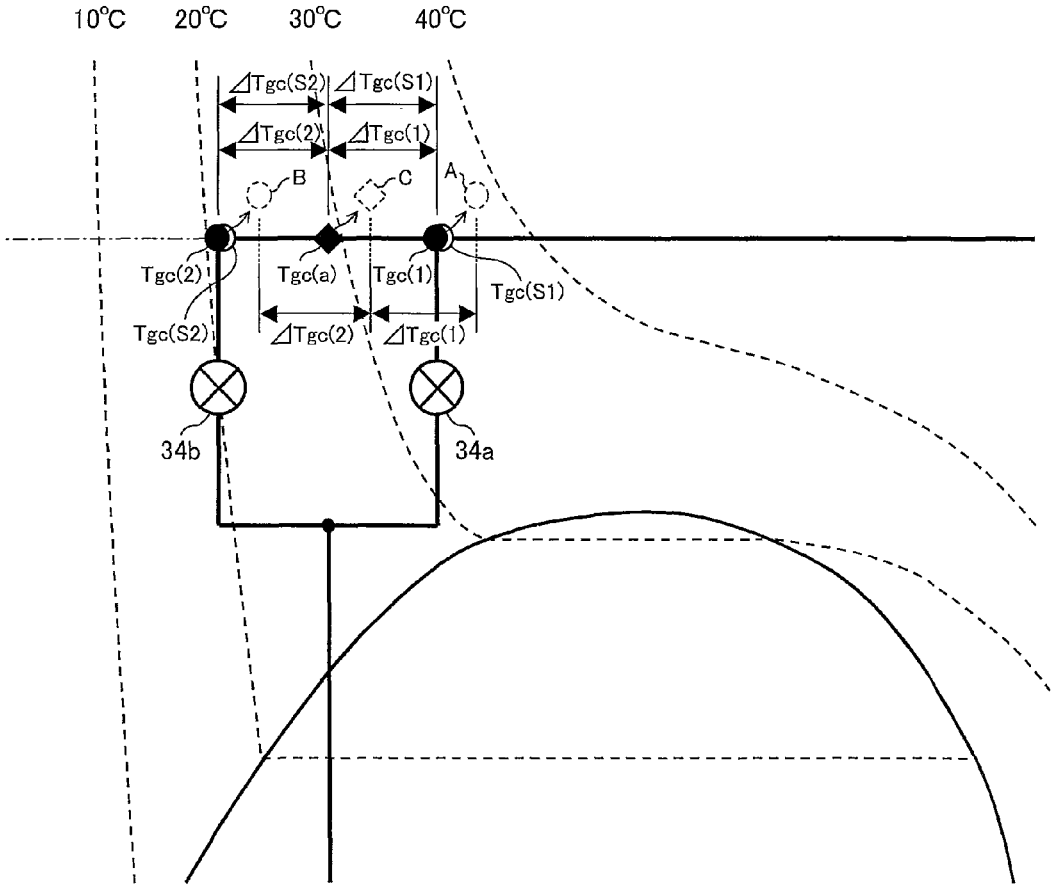
FIG. 2 is a diagram showing a relationship between a refrigerant pressure and a refrigerant temperature when the pressure of a high-pressure refrigerant varies in the embodiment.

As described above, the first refrigerant temperature sensor (42) and the second refrigerant temperature sensor (43) respectively detect the outlet refrigerant temperature Tgc(1) of the first indoor heat exchanger (33*a*) and the outlet refrigerant temperature Tgc(2) of the second indoor heat exchanger (33*b*). First, as illustrated in FIG. 2, the valve control part (50*a*) calculates an average value Tgc(a) from the outlet refrigerant temperature Tgc(1) and the outlet refrigerant temperature Tgc(2) to obtain a deviation ΔTgc(1) of the outlet refrigerant temperature Tgc(1) from the average value Tgc (a). The target refrigerant temperature of the outlet refrigerant temperature Tgc(1) of the first indoor heat exchanger (33*a*) is set at Tgc(S1). This target refrigerant temperature Tgc(S1) is calculated based on the difference between the indoor air temperature detected by the first indoor-temperature sensor (44) in the room in which the first indoor unit (30*a*) is located and the target temperature of the indoor air temperature set by a user. That is, the target refrigerant temperature Tgc(S1) varies according to a change in the target temperature of the indoor air temperature set by the user.

The valve control part (50*a*) calculates a target value ΔTgc (S1) as a deviation of the target refrigerant temperature Tgc (S1) from the average value Tgc(a), and then adjusts the opening degree of the first indoor expansion valve (34*a*) such that the deviation ΔTgc(1) approaches the target value ΔTgc (S1). In this manner, the outlet refrigerant temperature Tgc(1) of the first indoor heat exchanger (33*a*) is controlled.

The outlet refrigerant temperature Tgc(2) of the second indoor heat exchanger (33*b*) is controlled in the same manner as the outlet refrigerant temperature Tgc(1) of the first indoor heat exchanger (33*a*). Specifically, the target refrigerant temperature of the outlet refrigerant temperature Tgc(2) is set at Tgc(S2), and the valve control part (50*a*) adjusts the opening degree of the second indoor expansion valve (34*b*) such that a deviation ΔTgc(2) of the outlet refrigerant temperature Tgc (2) from the average value Tgc(a) approaches a target value ΔTgc(S2) as a deviation of the target refrigerant temperature Tgc (S2) from the average value Tgc(a).

Operational Behavior

Then, operational behavior of the air conditioner (1) of this embodiment will be described. The air conditioner (1) can perform heating operation by each of the indoor units (30*a*, 30*b*) and cooling operation by each of the indoor units (30*a*, 30*b*).

First, heating operation is described. In this heating operation, the first indoor expansion valve (34*a*) and the second indoor expansion valve (34*b*) serve as flow-rate control valves for controlling the flow rates of refrigerants respectively flowing in the first indoor heat exchanger (33*a*) and the second indoor heat exchanger (33*b*). The four-way selector valve (25) is switched to the state indicated by the solid lines in FIG. 1.

As illustrated in FIG. 1, a refrigerant compressed to have a critical pressure or more in the compressor (22) is divided into parts which respectively flow into the first branch pipe (32*a*) and the second branch pipe (32*b*) through the four-way selector valve (25) and the first connection pipe (11).

The refrigerant which has flown into the first branch pipe (32*a*) enters the first indoor heat exchanger (33*a*). In the first indoor heat exchanger (33*a*), the refrigerant dissipates heat to the indoor air. That is, in the first indoor heat exchanger (33*a*), heating operation of heating the indoor air is performed, and heating operation for the room in which the first indoor unit (30*a*) is located is performed. The refrigerant which has flown from the first indoor heat exchanger (33*a*) passes through the first indoor expansion valve (34*a*) to flow into the second connection pipe (12).

On the other hand, the refrigerant which has flown into the second branch pipe (32*b*) enters the second indoor heat exchanger (33*b*). In the second indoor heat exchanger (33*b*), the refrigerant dissipates heat to the indoor air. That is, in the second indoor heat exchanger (33*b*), heating operation of heating the indoor air is performed, and heating operation for the room in which the second indoor unit (30*b*) is located is performed. The refrigerant which has flown from the second indoor heat exchanger (33*b*) passes through the second indoor expansion valve (34*b*) to flow into the second connection pipe (12).

Thereafter, the refrigerant flowing in the second connection pipe (12) expands in the outdoor expansion valve (24), and evaporates (i.e., absorbs heat) in the outdoor heat exchanger (23) to be a gas refrigerant. This gas refrigerant passes through the four-way selector valve (25) to be sucked into the compressor (22). In the compressor (22), this refrigerant is compressed to have a critical pressure or more.

Behavior of the outlet refrigerant temperature Tgc(1) of the first indoor heat exchanger (33*a*) when the pressure of a refrigerant compressed in the compressor (22) varies in the refrigerant circuit (10) of this embodiment will be described with reference to the drawing.

In the refrigerant circuit (10), as illustrated in FIG. 2, first, based on the average value Tgc(a) of the outlet refrigerant temperatures Tgc(1) and Tgc(2) of the indoor heat exchangers (33*a*, 33*b*), the deviation ΔTgc(1) of the outlet refrigerant temperature Tgc(1) of the first indoor heat exchanger (33*a*) from the average value Tgc(a) is calculated, and the deviation ΔTgc(2) of the outlet refrigerant temperature Tgc(2) of the second indoor heat exchanger (33*b*) from the average value Tgc(a) is calculated. Next, the target value ΔTgc(S1) which is a deviation of the target refrigerant temperature Tgc(S1) of the outlet refrigerant temperature of the first indoor heat exchanger (33*a*) from the average value Tgc(a), is calculated. In this state, the deviation ΔTgc(1) is almost equal to the target value ΔTgc(S1), and thus, the outlet refrigerant temperature Tgc(1) does not need to be changed by adjusting the opening degree of the first indoor expansion valve (34*a*).

Then, when the pressure of the high-pressure refrigerant discharged from the compressor (22) increases, the outlet refrigerant temperature Tgc(1) of the first indoor heat exchanger (33*a*) moves to the position A, and the outlet refrigerant temperature Tgc(2) of the second indoor heat exchanger (33*b*) moves to the position B, accordingly. At this time, according to the movements of the outlet refrigerant temperatures Tgc(1) and Tgc(2), the average value Tgc(a) moves to the position C. Thus, the deviation ΔTgc(1) does not vary before and after a change in the pressure of the high-pressure refrigerant. Since the target refrigerant temperature Tgc(S1) does not vary, the target value ΔTgc(S1) does not vary before and after a change in the pressure of the high-pressure refrigerant.

Thus, since the deviation ΔTgc(1) and the target value ΔTgc(S1) are almost the same before and after a change in the pressure of the high-pressure refrigerant, the outlet refrigerant temperature Tgc(1) does not need to be changed by adjusting the opening degree of the first indoor expansion valve (34*a*).

Although not shown, the outlet refrigerant temperature Tgc(2) of the second indoor heat exchanger (33*b*) is controlled in the same manner as the outlet refrigerant temperature Tgc(1) of the first indoor heat exchanger (33*a*).

Control of the outlet refrigerant temperatures Tgc(1) and Tgc(2) when the target refrigerant temperature Tgc(S1) of the outlet refrigerant temperature Tgc(1) of the first indoor heat exchanger (33*a*) is changed, will be described hereinafter with reference to the drawings. The target refrigerant temperatures Tgc(S1) and Tgc(S2) of the outlet refrigerant temperatures of the indoor heat exchangers (33*a*, 33*b*) are changed based on target temperatures of the indoor air temperatures set by a user.

Figure 3:
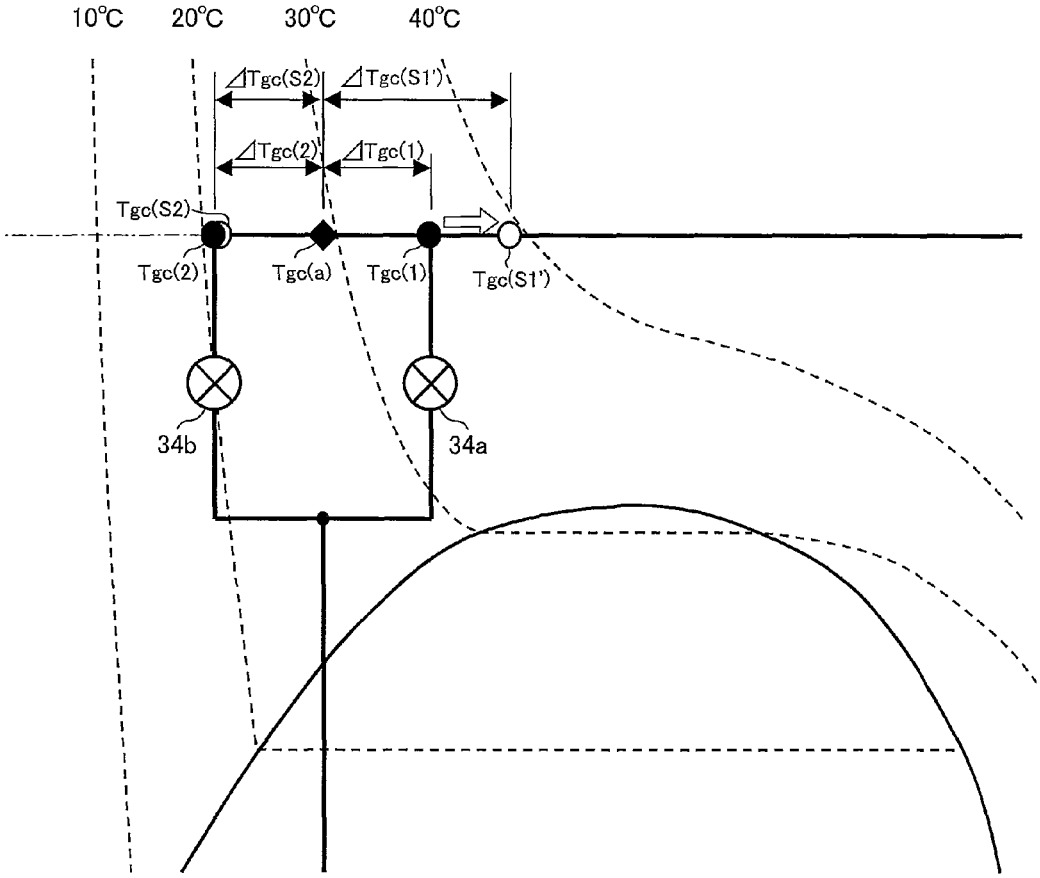
FIG. 3 is a diagram showing a relationship between the refrigerant pressure and the refrigerant temperature when an outlet refrigerant temperature of a heat exchanger varies in the embodiment.
Figure 4:
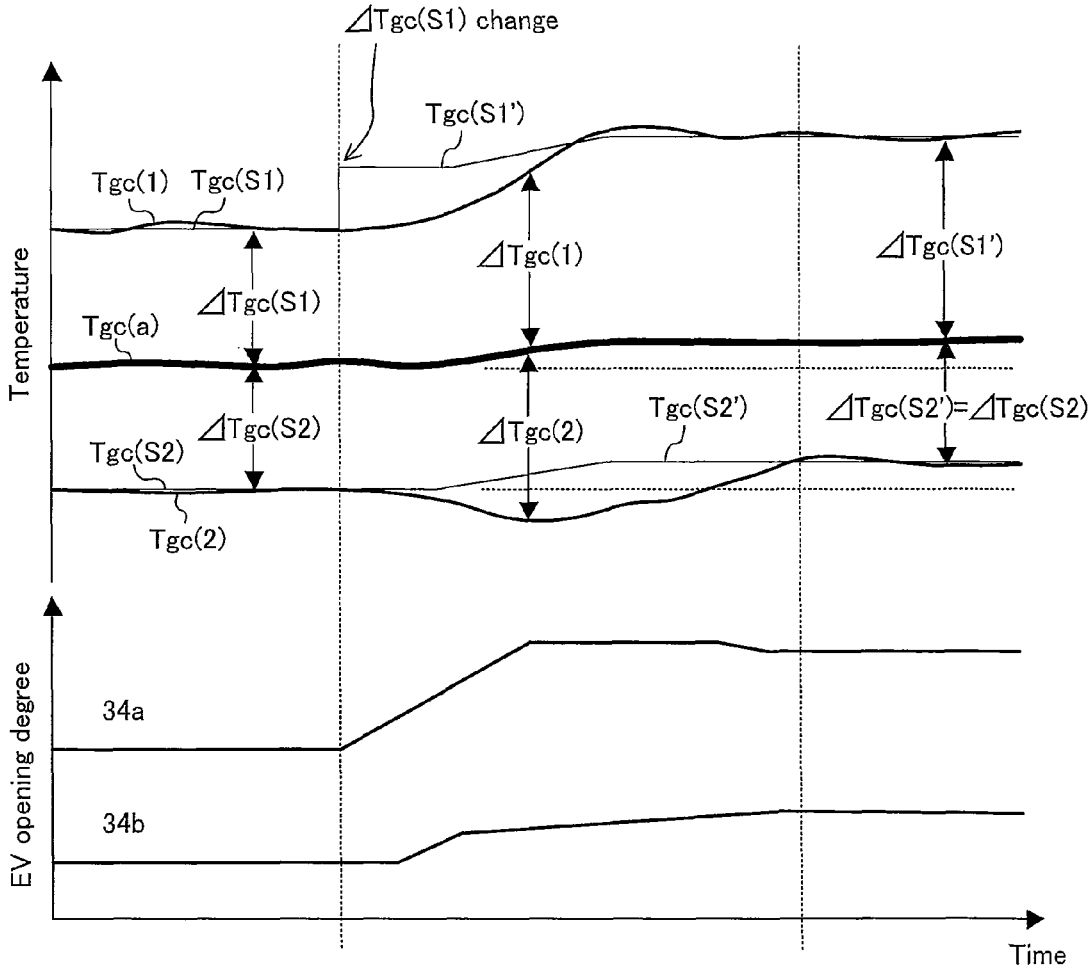
FIG. 4 is a diagram showing a relationship among the outlet refrigerant temperature, an opening degree of an indoor expansion valve, and time in the embodiment.
Figure 5:
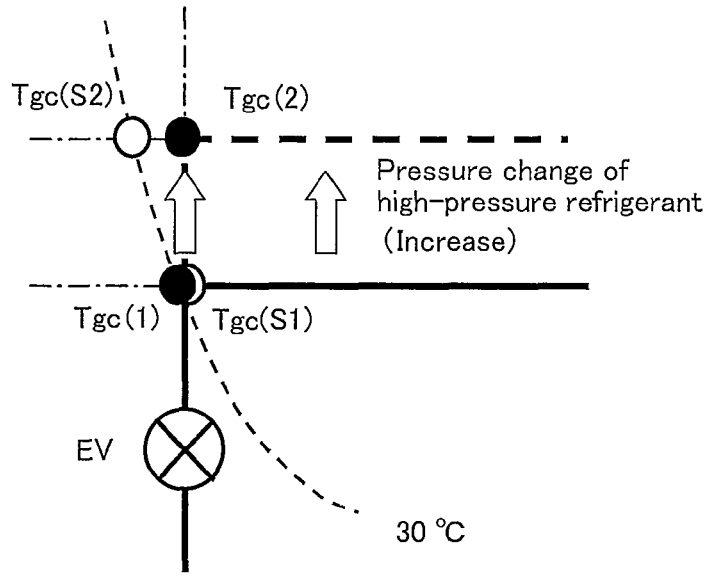
FIG. 5 is a diagram showing a relationship between a refrigerant pressure and a refrigerant temperature when the pressure of a high-pressure refrigerant increases in a conventional technique.
Figure 6:
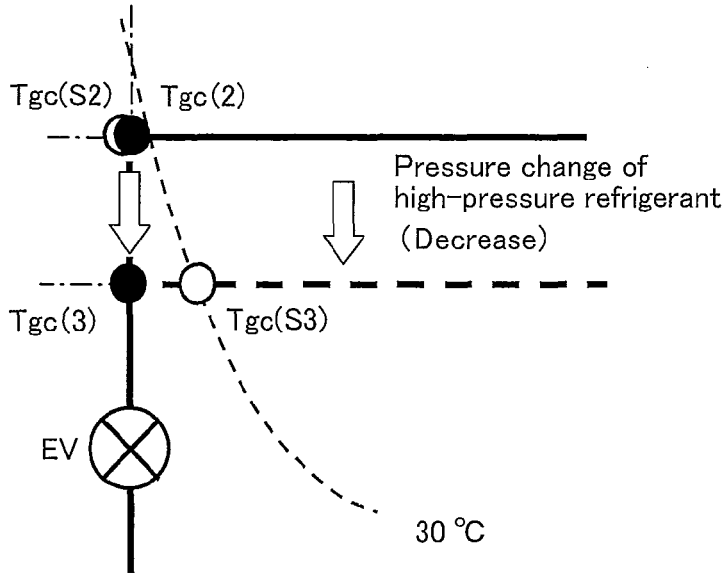
FIG. 6 is a diagram showing a relationship between the refrigerant pressure and the refrigerant temperature when the pressure of the high-pressure refrigerant decreases in the conventional technique.

As illustrated in FIGS. 3 and 4, the controller (50) changes the target refrigerant temperature Tgc(S1) of the first indoor heat exchanger (33*a*) to Tgc(S1') according to a change in the indoor air temperature by a user. Then, the target value ΔTgc (S1) increases to ΔTgc(S1'). Accordingly, the opening degree of the first indoor expansion valve (34*a*) is adjusted such that the deviation ΔTgc(1) approaches the target value ΔTgc(S1').

Specifically, the opening degree of the first indoor expansion valve (34*a*) is increased so that the amount of the refrigerant circulating in the first indoor heat exchanger (33*a*) increases. When the amount of the refrigerant circulating in the first indoor heat exchanger (33*a*) increases, the outlet refrigerant temperature Tgc(1) increases. Accordingly, the deviation ΔTgc(1) approaches ΔTgc(S1'), and the outlet refrigerant temperature Tgc(1) approaches Tgc(S1').

When the outlet refrigerant temperature Tgc(1) of the first indoor heat exchanger (33*a*) increases, the amount of the refrigerant circulating in the second indoor heat exchanger (33*b*) decreases. Accordingly, the outlet refrigerant temperature Tgc(2) of the second indoor heat exchanger (33*b*) decreases, and thus, the deviation ΔTgc(2) increases. With the increase in the outlet refrigerant temperature Tgc(1), the average value Tgc(a) slightly increases. However, since the target value ΔTgc(S2) does not vary with a change in the target refrigerant temperature Tgc(S1), the target refrigerant temperature Tgc (S2) slightly increases to Tgc(S2'). Then, the opening degree of the second indoor expansion valve (34*b*) is adjusted such that the deviation ΔTgc(2) approaches the target value ΔTgc(S2') (=ΔTgc(S2)).

Specifically, the opening degree of the second indoor expansion valve (34*b*) is increased to increase the amount of the refrigerant circulating in the second indoor heat exchanger (33*b*). When the amount of the refrigerant circulating in the second indoor heat exchanger (33*b*) increases, the outlet refrigerant temperature Tgc(2) increases. Accordingly, as the deviation ΔTgc(2) approaches the target value ΔTgc(S2'), the outlet refrigerant temperature Tgc(2) approaches the target refrigerant temperature Tgc(S2'). Accordingly, as the outlet refrigerant temperature Tgc(1) of the first indoor heat exchanger (33*a*) increases, the outlet refrigerant temperature Tgc(2) of the second indoor heat exchanger (33*b*) slightly increases.

The average value Tgc(a) is an average of the outlet refrigerant temperatures Tgc(1) and Tgc(2) of the indoor heat exchangers (33*a*, 33*b*). Thus, as the number of indoor heat exchangers connected in parallel to each other increases, an increase in the average value Tgc(a) according to an increase in the target refrigerant temperature Tgc(S1) is suppressed.

On the other hand, in cooling operation of the air conditioner (1), the first indoor expansion valve (34*a*) and the second indoor expansion valve (34*b*) serve as expansion valves, and the outdoor expansion valve (24) is held in a fully open state. The four-way selector valve (25) is switched to the state indicated by the broken lines in FIG. 1.

As illustrated in FIG. 1, a refrigerant compressed to have a critical pressure or more in the compressor (22), dissipates heat in the outdoor heat exchanger (23), and then is divided into parts which respectively flow into the first branch pipe (32*a*) and the second branch pipe (32*b*). The resultant refrigerants are subjected to pressure reduction in the first indoor expansion valve (34*a*) and the second indoor expansion valve (34*b*), and then evaporate in the first indoor heat exchanger (33*a*) and the second indoor heat exchanger (33*b*) to be gas refrigerants. These gas refrigerants are merged in the first connection pipe (11), and the merged refrigerant passes through the four-way selector valve (25) to be sucked in the compressor (22). In the compressor (22), this refrigerant is compressed to have a critical pressure or more.

Advantages of Embodiment

In the foregoing embodiment, deviations ΔTgc(1) and ΔTgc(2) of the outlet refrigerant temperatures Tgc(1) and Tgc(2) of the indoor heat exchangers (33*a*, 33*b*) to be controlled from the average value Tgc(a) of the outlet refrigerant temperatures Tgc(1) and Tgc(2) of all the indoor heat exchangers (33*a*, 33*b*), are calculated. Then, adjustment is performed such that these deviations ΔTgc(1) and ΔTgc(2) approach the target values ΔTgc(S1) and ΔTgc(S2) which are deviations of the target refrigerant temperatures Tgc(S1) and Tgc(S2) of the outlet refrigerant temperatures Tgc(1) and Tgc(2) from the average value Tgc(a). Accordingly, in the foregoing embodiment, even when the outlet refrigerant temperatures Tgc(1) and Tgc(2) of the indoor heat exchangers (33*a*, 33*b*) vary with a change in the pressure of the high-pressure refrigerant, the variations in the deviations ΔTgc(1) and ΔTgc(2) can be reduced. Consequently, even with a change in the pressure of the high-pressure refrigerant, the opening degree of each of the indoor expansion valves (34*a*, 34*b*) does not need to be adjusted. Thus, the outlet refrigerant temperatures Tgc(1) and Tgc(2) of the indoor heat exchangers (33*a*, 33*b*) can be controlled with stability. As a result, the heating capabilities of the indoor heat exchangers (33*a*, 33*b*) can be stabilized.

In addition, in the foregoing embodiment, the deviations of the target refrigerant temperatures Tgc(S1) and Tgc(S2) of the outlet refrigerant temperatures Tgc(1) and Tgc(2) of the indoor heat exchangers (33*a*, 33*b*) based on target indoor air temperatures from the average value Tgc(a) are used as target values. Thus, when the target refrigerant temperature Tgc(S1) of the outlet refrigerant temperature Tgc(1) of one indoor heat exchanger (33*a*) is changed, the outlet refrigerant temperature Tgc(1) of the indoor heat exchanger (33*a*) can follow the target refrigerant temperature Tgc(S1). As a result, control of the outlet refrigerant temperatures Tgc(1) and Tgc(2) of the indoor heat exchangers (33*a*, 33*b*) is not affected by a change in the pressure of the high-pressure refrigerant.

Further, since the deviations of the target refrigerant temperatures Tgc(S1) and Tgc(S2) of the target refrigerant temperatures Tgc(S1) and Tgc(S2) of the indoor heat exchangers (33*a*, 33*b*) based on target indoor air temperatures from the average value Tgc(a) are used, the degree (i.e., sufficient or insufficient) of the capability of each of the indoor heat exchangers (33*a*, 33*b*) can be easily determined. Accordingly, the outlet refrigerant temperatures Tgc(1) and Tgc(2) of the indoor heat exchangers (33*a*, 33*b*) according to the required capabilities of the indoor heat exchangers (33*a*, 33*b*) can be appropriately controlled. Consequently, an unnecessary input to the compressor (22) can be reduced, thereby saving energy. In addition, air conditioning ability corresponding to the required capability of each of the indoor heat exchangers (33*a*, 33*b*) can be obtained with stability, thereby enhancing comfortableness.

Other Embodiments

The foregoing embodiment may be modified in the following manner.

In the foregoing embodiment, the target refrigerant temperature of the outlet refrigerant temperature of each of the indoor heat exchangers (33*a*, 33*b*) is not changed according to a change in the pressure of the high-pressure refrigerant in the compressor (22). However, although not shown, the present invention is applicable to a case where the target refrigerant temperature is changed (set again) according to a change in the pressure of the high-pressure refrigerant.

The foregoing embodiment is directed to the air conditioner (1) capable of being switched between cooling operation and heating operation. However, the present invention is also applicable to an air conditioner dedicated to heating operation, i.e., an air conditioner performing only heating operation. In this case, the indoor expansion valve only needs to be a control valve (i.e., a flow-rate control valve) for adjusting the flow rate of a refrigerant flowing in the indoor heat exchanger.

The present invention is not limited to air conditioners, and is applicable to various types of refrigeration systems.

The present invention is not limited to two indoor units (30*a*, 30*b*), and is applicable to three or more indoor units. That is, the air conditioner (1) includes three or more indoor heat exchangers.

The foregoing embodiments are merely preferred examples in nature, and are not intended to limit the scope, applications, and use of the invention.

INDUSTRIAL APPLICABILITY

As described above, the present invention is useful for a refrigeration system performing a refrigeration cycle in which a high-pressure refrigerant has a pressure higher than or equal to a critical pressure.

The invention claimed is:

1. A refrigeration system, comprising:

a refrigerant circuit configured to perform a refrigeration cycle in which a high-pressure refrigerant has a pressure higher than or equal to a critical pressure, and including a heat-source side circuit including a compressor, a heat-source side heat exchanger, and an expansion mechanism, and a plurality of application side circuits which include application side heat exchangers connected to control valves with adjustable opening degrees and are connected in parallel to the heat-source side circuit; and a controller configured to control an outlet refrigerant temperature of each of the application side heat exchangers to a predetermined temperature during heat dissipation of each of the application side heat exchangers, wherein the controller includes a valve control part configured to adjust the opening degrees of the control valves of the application side circuits such that a deviation of the outlet refrigerant temperature of each of the application side heat exchangers of the application side circuits from an average of the outlet refrigerant temperatures of all the application side heat exchangers reaches a predetermined target value, and the target outlet refrigerant temperature used by the valve control part is a deviation, from the average outlet refrigerant temperature, of a target refrigerant temperature for the outlet refrigerant temperature of each of the application side heat exchangers based on a target air temperature of a room in which the each of the application side heat exchangers is located.

* * * * *